US005918311A

United States Patent [19]

Lampson et al.

[11] Patent Number: 5,918,311

[45] **Date of Patent: *Jul. 6, 1999**

[54] BIB HAVING IMPROVED POCKET OPENING

[75] Inventors: Patricia Lee Lampson; Amit Gupta, both of Cincinnati, Ohio

[73] Assignee: The Procter & Gamble Co., Cincinnati, Ohio

[ * ] Notice: This patent is subject to a terminal disclaimer.

[21] Appl. No.: 08/884,374

[22] Filed: Jun. 27, 1997

[51] Int. Cl.[6] ..... A41B 13/00

[52] U.S. Cl. ..... 2/49.2; 2/49.4

[58] Field of Search ..... 2/49.1, 49.2, 49.3, 2/49.4, 49.5, 50, 51, 52, 247

[56] References Cited

U.S. PATENT DOCUMENTS

| | | | |
|---|---|---|---|
| D. 238,521 | 1/1976 | Anderssen . | |
| 879,124 | 2/1908 | Thompson . | |
| 2,164,369 | 7/1939 | Woolever . | |
| 2,580,388 | 1/1952 | Allen . | |
| 3,010,111 | 11/1961 | Ralph | 2/49 |
| 3,945,048 | 3/1976 | Shearer | 2/49 R |
| 4,233,688 | 11/1980 | Hjerl . | |
| 4,261,057 | 4/1981 | Andersson | 2/49 R |
| 4,441,212 | 4/1984 | Ahr et al. . | |
| 4,445,231 | 5/1984 | Noel | 2/49 R |
| 4,649,572 | 3/1987 | Roessler | 2/49 R |
| 4,660,226 | 4/1987 | Quilling et al. . | |
| 4,706,303 | 11/1987 | VanGompel et al. | 2/49 R |
| 4,780,911 | 11/1988 | Mack . | |

FOREIGN PATENT DOCUMENTS

| | | | |
|---|---|---|---|
| WO 97/05793 | 2/1997 | WIPO | A41B 13/10 |

*Primary Examiner*—John J. Calvert
*Assistant Examiner*—Shirra L. Jenkins
*Attorney, Agent, or Firm*—Jay A. Krebs; Larry L. Huston; Gerry S. Gressel

[57] ABSTRACT

The present invention provides a bib having improved pocket opening. The pocket is formed by a pocket panel disposed adjacent a body panel. A pocket opening mechanism in combination with a predetermined hinge line sustain pocket opening. The pocket opening mechanism can comprise an elastic member, and the predetermined hinge can be provided by a crease formed by folding. In one embodiment, the bib includes an apron panel for facilitating gravitational opening of the pocket. The apron can comprise a longitudinally extending crease. The creases in each panel can extend generally parallel to a longitudinal centerline of the bib.

19 Claims, 8 Drawing Sheets

BIB HAVING IMPROVED POCKET OPENING

This application cross-references and incorporates by reference, commonly assigned U.S. patent application Ser. No. 08/513,496 "Bib Having an Improved Pocket" filed Aug. 10, 1995 in the name of Reinhart, now abandoned.

FIELD OF THE INVENTION

The present invention is related to disposable bibs, and more particularly, to a bib having a pocket for receiving spilled liquid and solid materials.

BACKGROUND OF THE INVENTION

Disposable bibs are well known in the art. Such bibs can be provided for use on babies during feeding. Disposable bibs can have a laminate construction comprising multiple layers. For instance, disposable bibs can include an absorbent paper topsheet for receiving spilled food material and a plastic film backsheet for preventing penetration of spilled liquids through the bib and onto the baby's clothing. Other multiple layer bib constructions are also known.

The prior art also discloses bibs having a pocket structure for receiving solids or liquids which would otherwise soil the wearer's clothing. An example of a bib having such a pocket is disclosed in U.S. Pat. No. 4,445,231 issued May 1, 1984 to Noel. Noel discloses a bib having a gravitationally openable pocket. Other references disclosing bibs with various structures for catching articles include U.S. Pat. Nos. 3,010,111 to Ralph; 3,945,048 to Shearer; 4,261,057 to Andersson; 4,649,572 to Roessler; and 4,706,303 to VanGompel.

One problem with known bibs is that pocket structures may not maintain an open configuration. Accordingly, the pocket structure may not be effective in capturing spilled materials.

Accordingly, it is an object of the present invention to provide a disposable bib which can be conveniently secured to the wearer's person.

Another object of the present invention is to provide a disposable bib having a pocket structure for receiving spilled food material.

Another object of the present invention is to provide a disposable bib having pocket structure, wherein the bib has one or more predetermined hinge lines, and wherein the bib has a pocket opening mechanism for providing deformation of the bib at the predetermined hinge line and opening of the pocket.

Another object of the present invention is to provide a bib having a pocket structure, wherein the bib has one or more predetermined hinge lines, such as a selectively located crease, and wherein at least a portion of the bib is foreshortened to provide deformation of the bib at the predetermined hinge line and opening of the pocket space.

SUMMARY OF THE INVENTION

The present invention provides a disposable bib. The bib has a body panel and a pocket panel disposed adjacent the body panel for providing a pocket space between the body panel and the pocket panel. One or both of the pocket panel and the body panel comprises a predetermined hinge line. The predetermined hinge line can be provided by, but is not limited to, a crease, fold, rib, or seam. The predetermined hinge line promotes bending of the panel along the predetermined hinge line.

The bib also includes a pocket opening mechanism for providing deformation of the bib at the predetermine hinge line and opening of the pocket space. In one embodiment, the pocket opening mechanism foreshortens at least a portion of the bib to provide deformation of the bib at the hinge line and opening of the pocket.

A portion of the pocket panel can be foreshortened. Alternatively, a portion of the body panel can be foreshortened. The predetermined hinge line can be disposed on a panel a portion of which is foreshortened. Alternatively, the predetermined hinge line can be disposed on one of the panels, and a portion of the other panel can be foreshortened.

Foreshortening can be provided by an elastic member disposed on one or both of the panels. The elastic member provides foreshortening of a portion of the bib in a direction inclined with respect to the hinge line.

The elastic member can provide lateral foreshortening of a portion of the bib, and the predetermined hinge line can be substantially aligned with the longitudinal centerline of the bib.

BRIEF DESCRIPTION OF THE DRAWINGS

While the specification concludes with claims particularly pointing out and distinctly claiming the present invention, the invention will be better understood from the following description taken in conjunction with the accompanying drawings in which like designations are used to designate substantially identical elements, and in which:

DETAILED DESCRIPTION OF THE INVENTION

Figure 1:
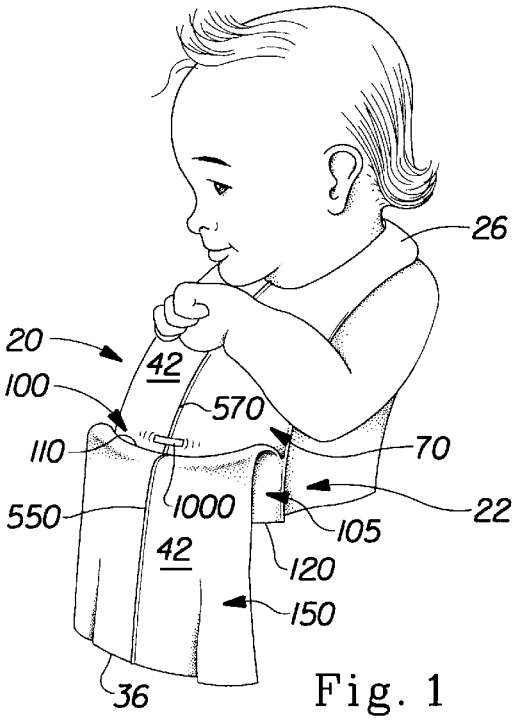
FIG. 1 is an in use perspective view of a disposable bib according to the present invention.
Figure 4:
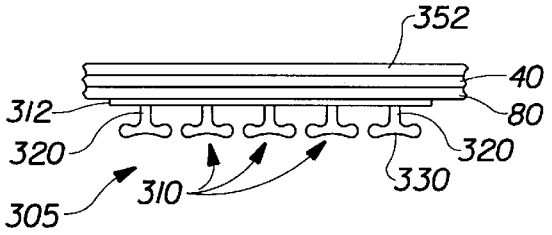
FIG. 4 is a cross-sectional view taken along lines 4—4 in FIG. 2
Figure 2:
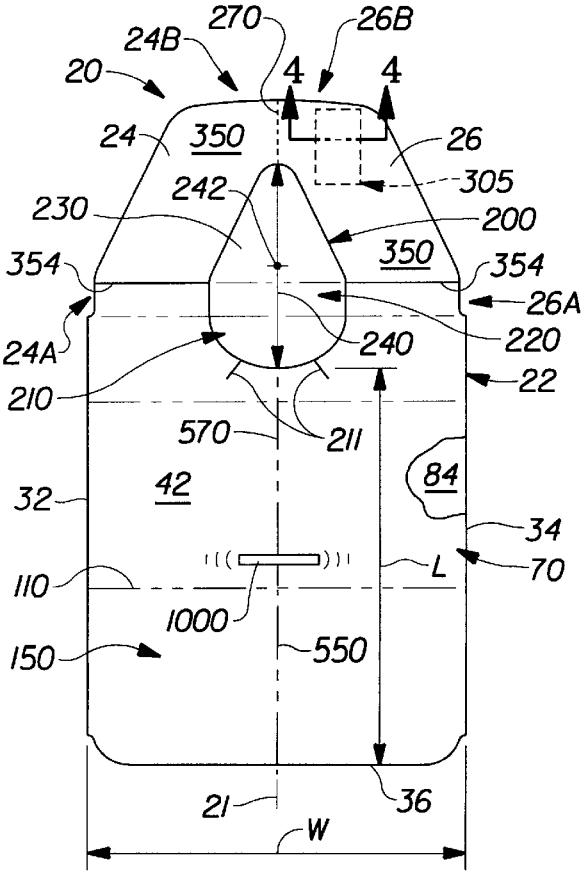
FIG. 2 a front plan view of the disposable bib of the present invention wherein the bib is supported in a flat, generally planar orientation.
Figure 3:
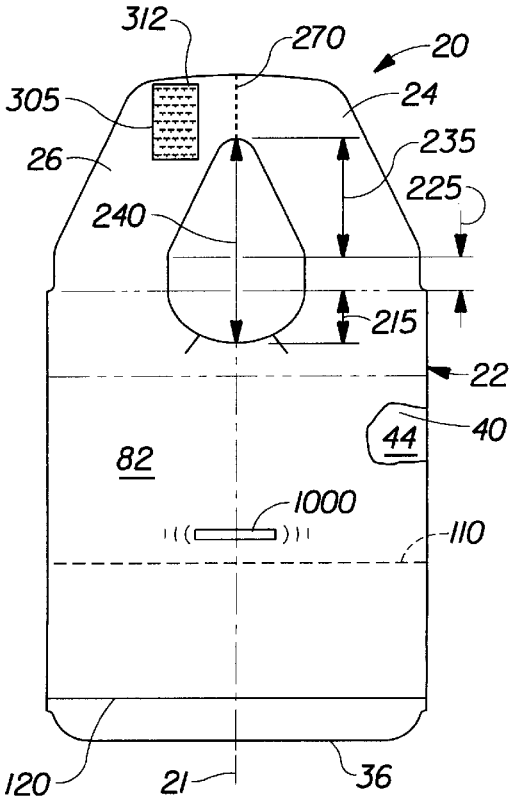
FIG. 3 is a rear plan view of a disposable bib of the present invention.

FIGS. 1–3 illustrate a disposable bib 20 according to one embodiment of the present invention. By "disposable" it is meant that the bib is constructed for single use, and intended to be discarded without further reuse.

The bib 20 comprises a bib body 22 having longitudinally extending sides 32 and 34, a longitudinal length L, a longitudinal centerline 21, a laterally extending bottom edge 36, and a lateral width W. The term "longitudinal" refers to an axis or direction measured along the length of the bib body 22, which direction or axis is generally parallel to a line extending from the wearer's head to the wearer's waist, as the bib is worn. The terms "lateral" and "transverse" refer to a direction or axis which is perpendicular to the longitudinal centerline 21, and which is generally parallel to a line extending across the wearer's chest as the bib is worn.

The bib 20 also comprises a pair of shoulder extensions 24, 26 having proximal ends 24A, 26A and distal ends 24B, 26B. The shoulder extensions 24, 26 extend from the bib body 22 from their proximal ends to their distal ends to provide a generally planar neck opening 200 when the bib is supported on a flat, horizontal surface.

The generally planar neck opening 200 has a front neck portion 210, a rear neck portion 230, and a maximum width portion 220 disposed intermediate the front neck portion 210 and the rear neck portion 230. The neck opening 200 also has a longitudinal length 240 measured along the longitudinal centerline 21. (FIG. 2), the longitudinal length having a midpoint 242.

The generally planar neck opening 200 is generally symmetric about a longitudinal axis, such as the longitudinal centerline 21, and is generally asymmetric about a lateral axis passing through the midpoint 242 of the longitudinal length 240 when the bib is supported on a flat, horizontal surface. The lateral asymmetry of the neck opening 200 promotes fit about different neck sizes and shapes without slipping, while reducing the tendency of the bib body 22 to gap away from the wearer's chest when the shoulder extensions 24, 26 are overlapped behind the wearer's neck to fasten the bib to the wearer.

The bib 20 also include a pocket 100 which can extend substantially the full lateral width of the bib 20 for catching and receiving food particles. In one embodiment, the bib body 22 can comprise a body panel 70, a pocket panel 105, and an apron panel 150. The body panel 70 can be separated from the pocket panel 105 by a laterally extending fold in the bib body, and the pocket panel 105 can be separated from the apron panel 150 by another parallel laterally extending fold in the bib body.

The body panel 70 is disposed adjacent the wearer's body when the bib is secured to the wearer. The pocket panel 105 can have a generally rectangular shape, and is disposed adjacent the body panel 70 to form a pocket space intermediate the body panel and the pocket panel. The pocket panel 105 extends longitudinally from a pocket bottom edge 120 to a pocket open edge 110, and the pocket panel 105 extends laterally intermediate the bib side edges 32 and 34. The bottom edge 120 and the open edge 110 can both be substantially perpendicular to the longitudinal centerline 21 and substantially parallel to an imaginary lateral axis.

The apron panel 150 can extend from the pocket open edge 110 to the bib bottom edge 36. The apron panel 150 can depend in a pendulous fashion from the pocket open edge 110 to provide gravitational opening of the pocket 100. The body panel 70, pocket panel 105, and apron panel 150 can be formed from a continuous sheet of material, the sheet of material comprising one or more laminae. U.S. Pat. No. 4,445,231 "Bib Having Gravitationally Openable Pocket" issued May 1, 1984 to Noel is incorporated herein by reference for the purpose of showing a bib construction for forming a bib having a pocket and an apron panel.

At least one of the body panel 70, the pocket panel 105, and the apron panel 150 comprise a predetermined hinge line. The predetermined hinge line promotes bending of the panel about the hinge line. The predetermined hinge line can be in the form of a crease (such as created by folding a panel), a rib, a seam, or other discontinuity which promotes bending of the panel along the hinge line.

In the embodiments, shown, the panels 70, 105, and 150 comprise predetermined hinge lines in the form of longitudinally extending creases 570, 505, and 550, respectively (FIGS. 1, 2, 8, 9, 10). Each of the creases 570, 505, and 550 can be substantially parallel to the longitudinal centerline of bib, and each crease can be substantially aligned with the longitudinal centerline 21 of the bib body 22. The pocket panel 105 and the body panel 70 are deformable by bending in a predetermined line defined by the longitudinally extending creases 505 and 570.

The bib 20 also comprises a pocket opening mechanism for providing deformation of the bib along at least one of the predetermined hinge lines and to provide opening of the pocket space. Referring to FIGS. 1 and 2, the pocket opening mechanism can comprise an elastic member 1000.

An elastic member is a member which under action of an applied force can be elongated by at least about 25 percent of its relaxed length and which will recover, upon release of the applied force, at least about 10 percent of its elongation. It is generally preferred that an elastic member of the present invention be capable of being elongated by at least about 50 percent of its relaxed length and recover at least about 75 percent of its elongation.

An elastic member 1000 can be joined to the body panel 70, the pocket panel 105, or both the body panel and pocket panel 105. Contraction of the elastic member foreshortens the portion of the bib to which the elastic member 1000 is attached, and provides deformation of the bib about at least one predetermined hinge line to promote opening of the pocket space. FIG. 2 illustrates an elastic member 1000 joined to the topsheet 40 on the body panel 70. FIG. 3 illustrates an elastic member 1000 joined to the backsheet 80 on the body panel 70. In both FIG. 1 and FIG. 2, the elastic member 1000 is joined to the bib to provide foreshortening of a portion of the body panel 70 associated with the pocket open edge 110. The elastic members 1000 in FIGS. 1 and 2 are positioned longitudinally intermediate the pocket open edge 110 and the neck opening 200, and the elastic members 1000 foreshorten a portion of the body panel above the open edge 110 and longitudinally spaced from the pocket space formed between the body panel 70 and the pocket panel 105.

The bib 20 also preferably comprises a fastening assembly for joining together the shoulder extensions 24 and 26 in an overlapping fashion, to thereby secure the bib 20 to the wearer. The fastening assembly can comprise a mechanical fastener having elements disposed on at least one of the shoulder extensions, which elements penetrate and physically engage a landing surface on the other shoulder extension. In one embodiment, the fastener can comprise an array 305 of projections 310 extending from a substrate 312 joined to the shoulder extension 26. The projections 310 are engagable with a landing surface, the landing surface being disposed on at least a portion of the shoulder extension 24. In FIG. 2, the landing surface comprises the surface 350 of a nonwoven web 352 joined to a portion of the topsheet 40, the nonwoven web terminating at an edge 354.

Referring to the components of the bib 20 in more detail, the bib 20 according to the present invention can comprise a composite construction having multiple laminae. For instance, the bib 20 can comprise a laminate of an absorbent outer topsheet layer 40 and a garment facing backsheet layer 80 which is liquid impermeable relative to the topsheet 40. The topsheet 40 has a first outer surface 42 for receiving spilled food material, and a second inner surface 44. The backsheet 80 has a first garment facing surface 82 and a second surface 84. The surface 84 of the backsheet 80 and the surface 44 of the topsheet 40 are oppositely facing surfaces, and can be joined together, such as with an adhesive, to form a laminate. In the embodiments shown, the shoulder extensions 24, 26, the bib body panel 70, the pocket panel 105, and the apron panel 150 are formed from a single, continuous sheet of the laminate of the topsheet 40 and the backsheet 80. Alternatively, the panels 70, 105, and 150 could be separate pieces joined together in any suitable manner, such as with adhesives.

The topsheet 40 can comprise a paper web having a basis weight of from about 10 to about 50 pounds per three thousand square feet. The following U.S. Patents are incorporated by reference for the purpose of disclosing how to make tissue paper suitable for use in making a topsheet 40: U.S. Pat. Nos. 4,529,480; 4,637,859; 5,223,096; and 5,240,562. A suitable topsheet 40 can be formed from a single ply or multiple ply paper towel, such as a Bounty Paper Towel manufactured by The Procter and Gamble Company of Cincinnati, Ohio.

The backsheet 80 can comprise a liquid impervious polymeric film, such as a polyolefinic film. In one embodiment the backsheet 80 can comprise a polyethylene film having a thickness of between about 0.3 mil and about 4.0 mil (about 0.0003 inch to about 0.0040 inch). In one embodiment the backsheet can comprise a FS-II embossed Polyethylene film having a thickness of about 2 mil and manufactured under the designation CPC-2 (P-9703) by Tredegar Film Products of Cincinnati, Ohio.

The topsheet 40 can be joined to the backsheet 80 in any suitable manner, including but not limited to methods such as adhesive bonding, mechanical bonding, and ultrasonic bonding. A suitable adhesive for joining the topsheet 40 and the backsheet 80 is a hot melt adhesive such as a hot melt pressure sensitive adhesive. Suitable adhesives include adhesives designated HL-1258 and HL 1262 manufactured by H. B. Fuller Co. of St. Paul, Minn. Other suitable adhesives include Findley Adhesives H2031 and H2120 available from Findley Adhesives of Elmgrove, Wis.

A plurality of slits 211 cut through the topsheet 40 and backsheet 80 can extend in a generally radial fashion from the perimeter of the neck opening 200. The slits 211 provide a close yet comfortable fit against the wearer's neck. Such slits, or bifurcations, are disclosed generally in U.S. Pat. No. 4,416,025 to Moret, which Patent is incorporated herein by reference.

Prior to the time the bib is to be used, the shoulder extensions 24 and 26 can be joined together, such as at their distal ends 24B, 26B, along a selective line of weakening 270. When the bib is to be used, the shoulder extensions are separable along the selective line of weakening 270, such that the shoulder extensions can be separated without tearing or otherwise damaging other portions of the bib, and releasably joined together in an overlapping fashion by the fastening assembly.

In one embodiment, the selective line of weakening 270 is aligned with the longitudinal centerline 21, and comprises a plurality of spaced apart perforations 271. The perforations 271 extend partially or fully through the thickness of the bib 200. The perforations can be formed with a perforating knife, and can extend through each of the backsheet 80, topsheet 40, and nonwoven web 352.

In one embodiment of the present invention, the predetermined hinge lines are creases formed by folding selected portions of the bib. The creases can be positioned to facilitate opening of the pocket 100, and together with the pocket opening mechanism, maintain the pocket 100 in an open configuration. In particular, the predetermined hinge lines can be formed by folding the bib panels 70 and 105 to form longitudinally extending creases which are spaced from the side edges 32 and 34 of the bib.

The pocket opening mechanism can comprise one or more elastic members 1000. The elastic member 1000 can be joined to the bib before or after the pocket is formed, and is preferably joined to the bib prior to forming the creases which facilitate opening of the pocket 100.

The elastic member 1000 is preferably positioned along the longitudinal centerline 21 and oriented to provide lateral foreshortening of a portion of the bib. In one embodiment, the elastic member 1000 can be positioned along the longitudinal centerline 21 intermediate the pocket open edge 110 and the neck opening 200.

Figure 6:
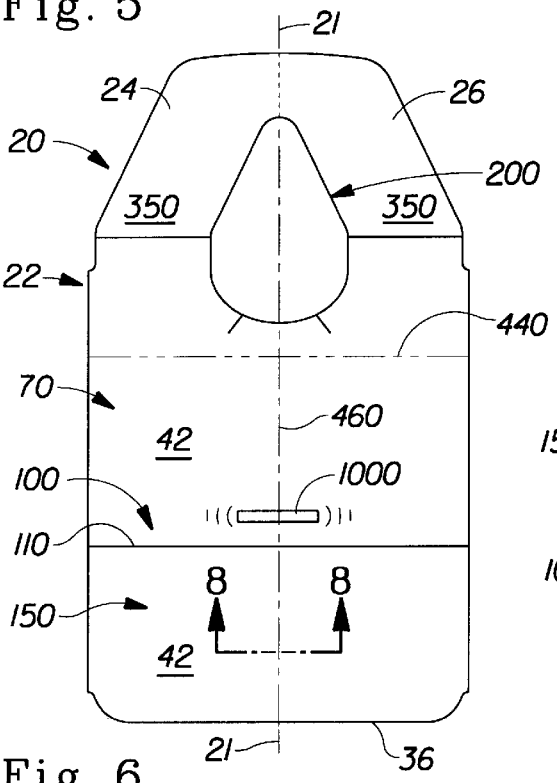
FIG. 6 is a front plan view of the present invention showing an elastic member joined to a portion of the body panel to laterally foreshorten a portion of the body panel adjacent to the pocket open edge, wherein the elastic member is closer to the pocket open edge than to the bottom of the pocket panel.

In FIG. 6, an elastic member 1000 is joined to the surface 42 of the topsheet 40 adjacent to the pocket open edge 110. Alternatively, the elastic member 1000 could be positioned along the longitudinal centerline 21 to be closer to the neck opening 200 than to the open edge 110.

Figure 7:
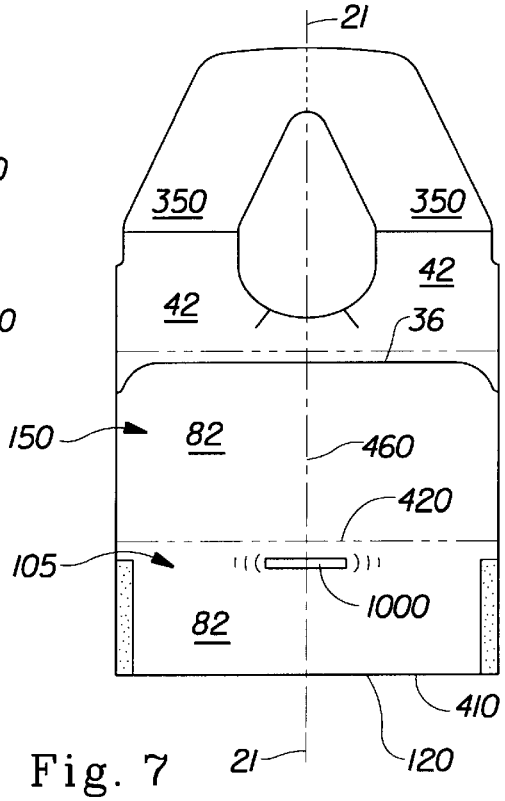
FIG. 7 is a front view of a bib according to the present invention in a configuration with the apron panel folded upward, the figure showing an elastic member joined to a portion of the pocket panel adjacent to the pocket open edge, wherein the elastic member is closer to the pocket open edge than to the bottom of the pocket panel.

In FIG. 7, an elastic member 1000 is joined to the surface 82 of the backsheet 80. In both FIGS. 6 and 7, the elastic member is positioned adjacent to the pocket open edge 110, and the spacing of the elastic member 1000 from the pocket open edge 110 is less than the spacing of the elastic member 1000 from the pocket bottom edge 120. Such positioning provides foreshortening of a portion of the bib adjacent to the open edge 110 to enhance opening of the pocket.

The elastic member 1000 can be joined to the bib at the ends of the elastic member, intermittently along the length of the elastic member, or continuously along the length of the elastic member. The elastic member 1000 can be joined to a portion of the bib with any suitable bonding method, including but not limited to adhesives and double sided tape.

A suitable elastic member is a Fulfex 9411 brand elastic strand having dimensions of about 0.0095 inch by 3/32 inch, and available from the Fulflex Company of Middleton, R.I. The elastic strand can be cut to have a length of between about 3.5 inch to about 4.0 inch, and elongated to twice its relaxed length ( i.e. 7 to 8 inches). A piece of 3M Transfer Adhesive (supplier ID 1524) double sided tape (available from The 3M Company of St. Paul, Minn.) having a length about equal to the elongated length of the elastic member can be attached to the bib in the desired position, and the elongated elastic member can be pressed into the double sided tape to join the elastic member to the bib. The elastic member and the exposed side of the double sided tape can then be covered, such as with a piece nonwoven web cut to the length and width of the double sided tape, to cover the exposed adhesive on the double sided tape.

Alternatively, one or both of the panels 70 and 105 can be formed of an elastically extensible material. The elastically extensible material can be laterally elongated prior to attaching the panels together along the side edges 32 and 34. Contraction of the elastic material from which the panel is formed would result in foreshortening of the panel, and bending of one or more panels along a predetermined hinge line.

Other suitable pocket opening mechanisms which can be used in cooperation with the predetermined hinge lines include, but are not limited to, spacing members for separating the pocket panel 105 from the body panel 70. Such spacing members can be resilient and can bias the pocket panel 105 away from the body panel. One such spacing member is disclosed in U.S. Pat. No. 3,010,111 to Ralph, which patent is incorporated herein by reference. Another suitable pocket opening mechanism is a form sustaining stay disclosed in U.S. Pat. No. 4,441,212 issued to Ahr et al., which patent is incorporated herein by reference.

The bib 20 can be constructed and folded as described below.

Figure 5:
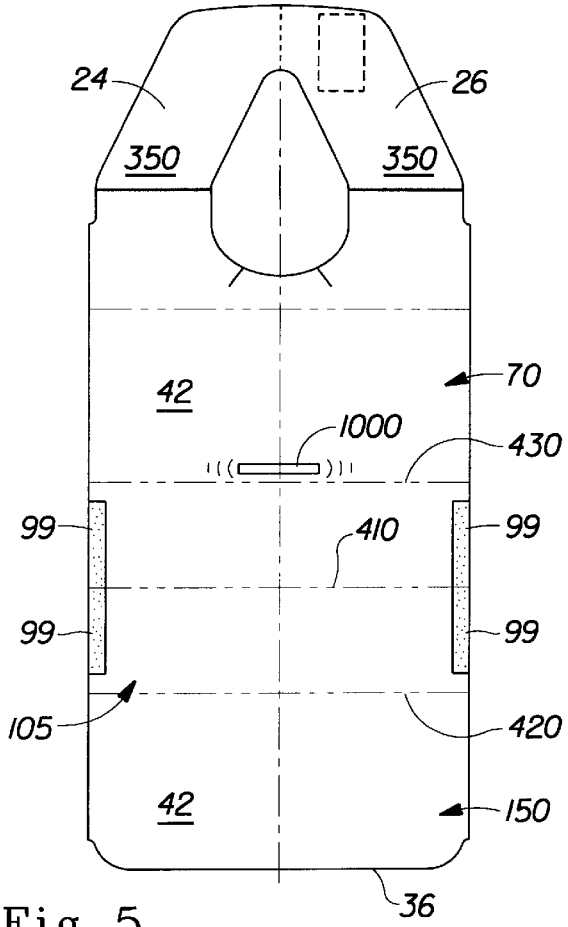
FIG. 5 is a front plan view of a partially assembled bib showing the outer perimeter of the bib and the neck opening, and prior to folding of the bib body to form a pocket panel and an apron panel.

FIG. 5 shows a partially constructed bib structure. In FIG. 5, the neck opening 200 and the outer perimeter of the bib have been cut from a sheet of material comprising a topsheet 40 layer adhesively joined to a backsheet 80 layer. In addition, a nonwoven web 352 has been secured to cover the shoulder extensions 24 and 26. An elastic member 1000 is shown attached to the sheet of material comprising the topsheet and the backsheet. In FIG. 5, the pocket 100 has not yet been formed.

In FIG. 5, adhesive 99 has been applied along the edges of the partially constructed bib. The partially constructed bib can then be folded along a fold line 410, to create pocket bottom edge 120, and to position the pocket panel 105 adjacent the body panel 70, such that the pocket panel 105 overlies a bottom portion of the body panel 70. The adhesive 99 joins the longitudinally extending edges of the pocket panel 105 to the bottom portions of the longitudinally extending edges of the body panel 70, such that the pocket 100 is closed along the pocket bottom edge 120 and along it longitudinally extending side edges.

The pocket panel 105 is preferably seamless intermediate its longitudinally extending edges, such that pocket panel 105 extends as a single unitary panel intermediate its longitudinally extending edges. While seams can be used to form hinge lines in a panel, seams such as those formed by joining together two edges of pieces of material with adhesive, are undesirable in the pocket panel 105 because they require added construction steps, and because seams can affect the operation of the creases formed in the panel by folding.

The partially constructed bib can then be folded along a fold line 420 which is parallel to a lateral axis, to create a crease forming the pocket open edge 110, and such that the apron panel 150 overlies the pocket panel 105.

In one embodiment, the body panel 70 can optionally also be folded along a laterally extending fold line 430. The fold line 430 is generally parallel to, and underlies, the pocket open edge 110. Folding the body panel 70 along the fold line 430 creates a crease 530 (FIG. 10) in the body panel 70 which is generally parallel to, and underlies, the pocket open edge 110 when the bib 20 is in a generally planar configuration.

The bib body panel 70 can next be folded along fold line 440. The bib body panel can be folded along fold line 440 with the bib in the configuration shown in FIG. 7. Alternatively, the bib can be folded along fold line 440 with the bib in the configuration shown in FIG. 6.

According to the present invention, the bib can be folded along a longitudinally extending fold line 460 to form at least one longitudinally extending crease in each of the body panel 70 and the pocket panel 105. A crease in the apron panel 150 can also be provided.

Without being limited by theory, it is believed that such creases, in combination with the pocket opening mechanism such as elastic member 1000, aid in maintaining the pocket 100 in an open configuration. The elastic member 1000 foreshortens one or both of the panels 70 and 105 laterally, in a direction generally perpendicular to the longitudinally extending creases in the panels 70 and 105.

Depending on the configuration of the bib when the fold along line 460 is made, the resulting creases in the body panel 70, the pocket panel 105, and the apron panel 150 can be convex outward or concave outward.

For instance, with the apron panel 150 in the configuration shown in FIG. 7 (with the panel 150 folded upward over a portion of the body panel 70) when the bib is folded along fold line 460, the bib can be folded so that edges of the bib are rotated upward out of the plane of FIG. 7. Then, when the apron panel 150 is folded down to the configuration shown in FIG. 6, longitudinal creases will be as shown in FIG. 8, which is a cross-sectional view through the panels of the bib taken along line 8—8 in FIG. 6.

Figure 8:
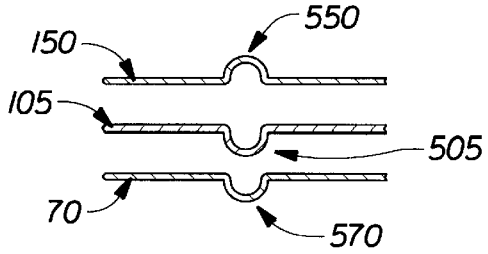
FIG. 8 is a cross-sectional view through the body panel, pocket panel, and apron panel taken along lines 8—8 in FIG. 6, and showing an apron panel having a convex outward crease, a pocket panel having a concave outward crease, and the body panel having a concave outward crease.
Figure 10:
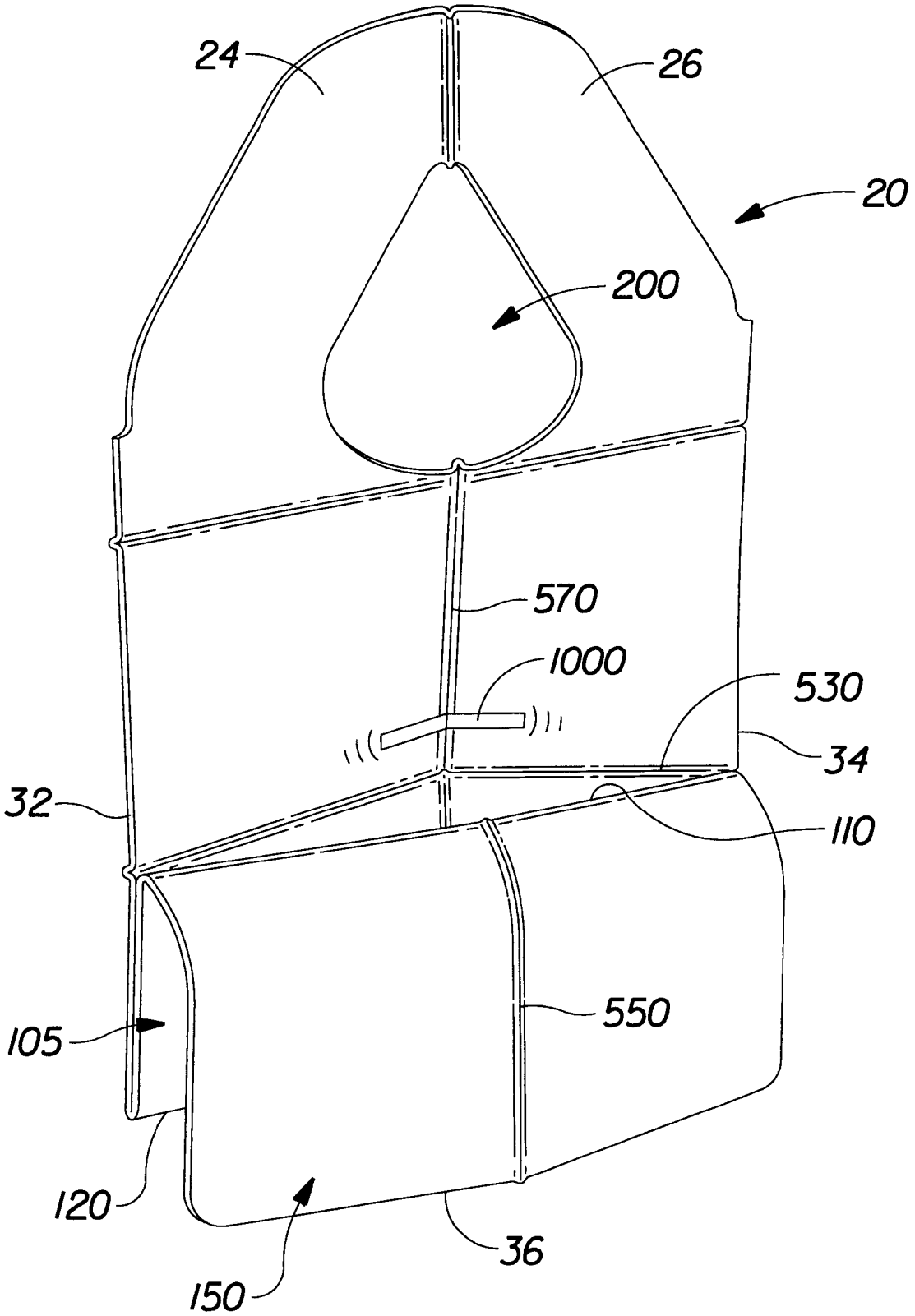
FIG. 10 is a perspective view showing the elastic member joined to the body panel and foreshortening a portion of the body panel to provide bending of the body panel about a crease aligned with the bib centerline, and to provide opening of the pocket space.

Referring to FIGS. 8 and 10, such folding provides a longitudinally extending crease 550 on the apron panel 150, a longitudinally extending crease 505 on the pocket panel 105, and a longitudinally extending crease 570 on the portion of the body panel 570 subjacent the pocket panel. The crease 550 is convex outward, and the creases 505 and 570 are concave outward (outward is the direction away from the wearer's body as the bib is worn, so that the convexity of the crease 550 in the apron panel 150 is opposite to that of the crease 505 in the pocket panel 105.

The crease 570 aids in holding the pocket 100 open. Referring to FIG. 10, contraction of the elastic member 1000 foreshortens the portion of the body panel 70 adjacent to the pocket open edge 110 and positioned along the longitudinal centerline 21. The elastic member 1000 causes bending of the body panel 70 along the crease 570, such that the body panel 70 is spaced from pocket panel 105. Accordingly, the pocket space between the body panel 70 and the pocket panel 105 is maintained in an open configuration.

In an alternative embodiment, the partially constructed bib in FIG. 5 can first be folded along the fold line 430 so that the surface 42 below the line 430 overlies and faces the surface 42 above the line 430. The partially constructed bib can then be folded along a longitudinally extending line to form a convex outward crease 550, a convex outward crease 505, and a concave outward crease 570. Next, the partially constructed bib can be unfolded along the longitudinally extending line to the configuration shown in FIG. 7. The bib construction can then be completed by folding and gluing pocket panel 105, and folding apron panel 150. The resulting panel creases are shown in FIG. 9.

Figure 9:
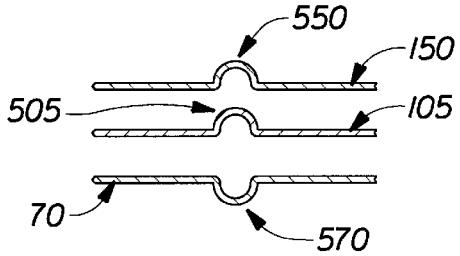
FIG. 9 is a cross-sectional view through the body panel, pocket panel, and apron panel similar to that in FIG. 8, and showing an apron panel having a convex outward crease, a pocket panel having a convex outward crease, and the body panel having a concave outward crease.

The crease configuration of FIG. 9 provides advantages in channeling spilled material into the pocket 100. A concave outward crease 570 provides the bib body with a shape which directs spills toward the longitudinal centerline 21. A concave outward crease 570 coupled with a convex outward crease 505 promotes separation of the pocket panel 105 from the body panel 70, especially along the longitudinal centerline 21.

Other crease arrangements can also be constructed, such that the creases 550, 505, and 570 are: all convex outward; all concave outward; 550 and 570 convex outward, 505 concave outward; 550 concave outward, 505 and 570 convex outward; 550 and 505 concave outward, 570 convex outward; and 550 and 570 concave outward, 505 convex outward.

Figure 11:
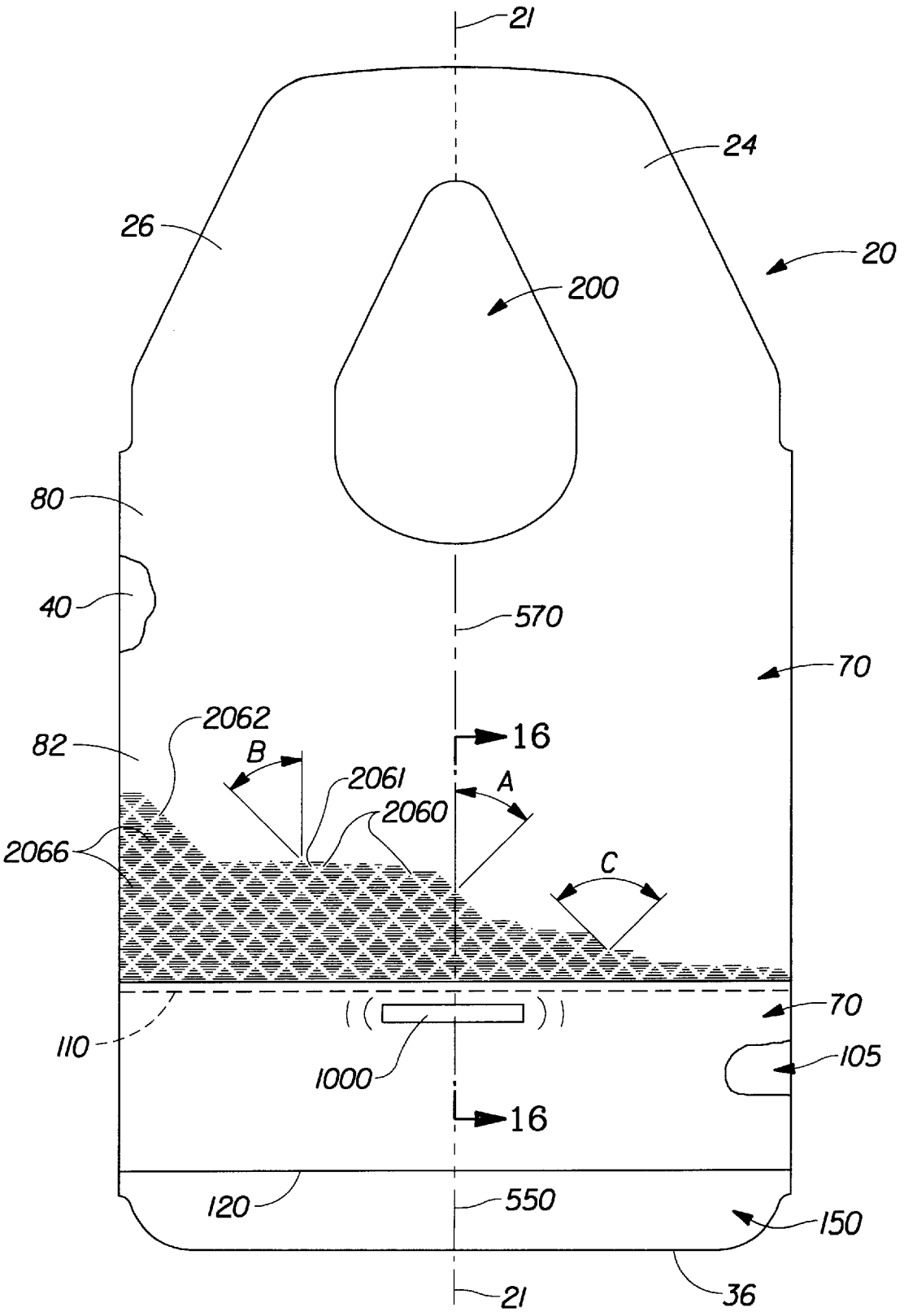
FIG. 11 is an illustration of a bib wherein a portion of the body panel comprises a strainable network.
Figure 12:
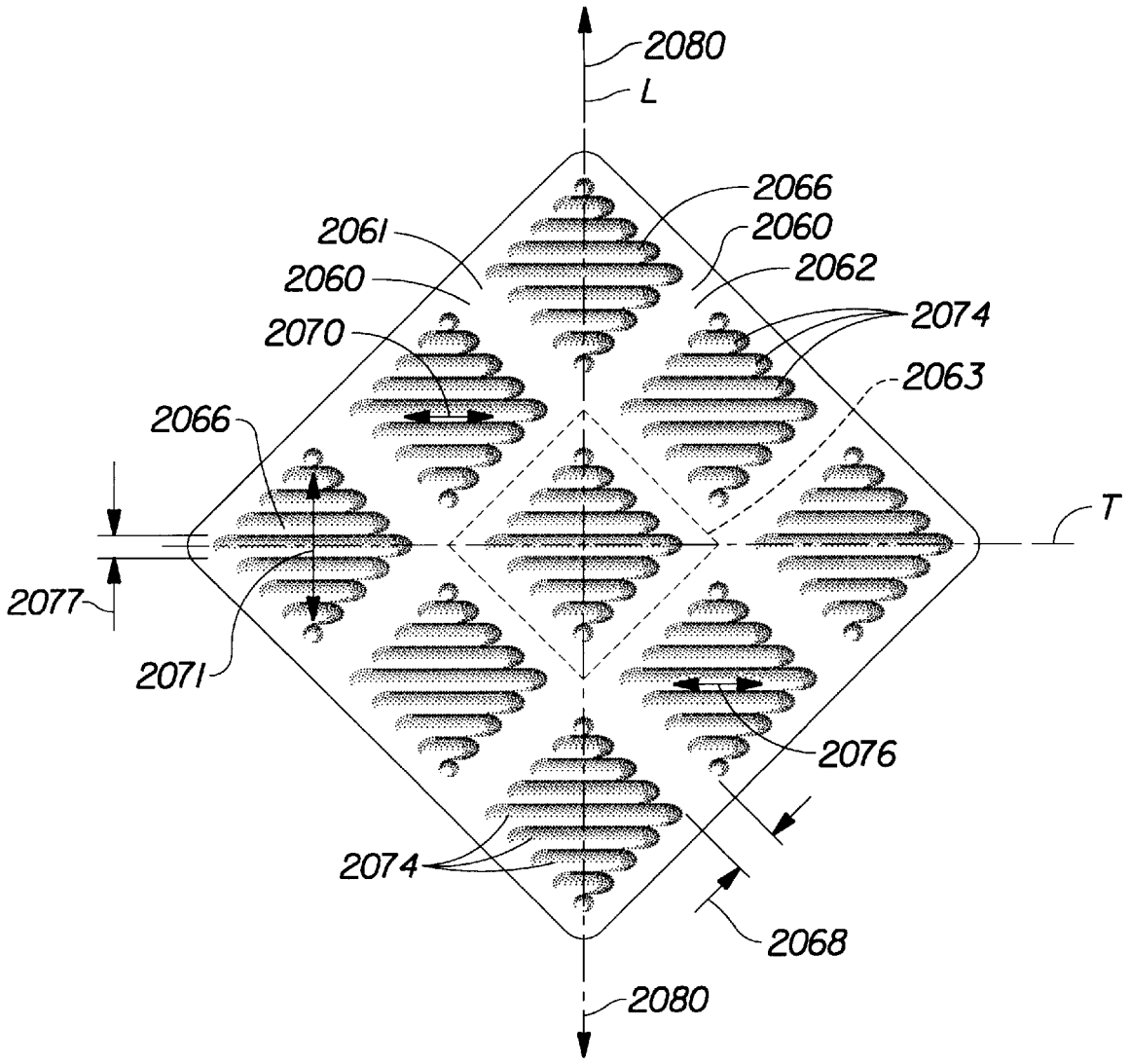
FIG. 12 is an enlarged illustration of the strainable network of the type shown in FIG. 11.

FIGS. 11 and 12 illustrate an alternative embodiment of the present invention wherein a portion of the bib comprises a strainable network. The strainable network can provide the bib with elastic like behavior in one or more directions. In FIG. 11, the bib is shown with the surface 82 facing the viewer. A portion of the body panel 70 is cut away to show an underlying portion of the pocket panel 105.

In FIG. 11, a portion of the body panel 70 above the pocket edge 110 comprises a strainable network, while the portion of the body panel 70 which underlies and is adjacent to the pocket panel 105 does not include a strainable network.

Referring to FIGS. 11 and 12, a bib 20 according to an alternative embodiment of the present invention can comprise a strainable network which includes a plurality of first regions, indicated by reference numeral 2060 in FIG. 11, and a plurality of second regions, indicated by reference numeral 2066. A portion of the first regions 2060, indicated generally as 2061, are substantially linear and extend in a first direction. The remaining first regions 2060, indicated generally as 2062, are substantially linear and extend in a second direction which is different from the first direction.

The first regions 2060 undergo a molecular level and geometric deformation and the second regions 2066 initially undergo a substantially geometric deformation when the bib is subjected to an applied elongation along at least one axis. Such a strainable network is described generally in commonly assigned U.S. patent application Ser. No. 08/656,129, entitled "Web Materials Exhibiting Elastic-Like Behavior and Soft Cloth-Like Texture" filed May 31, 1996 in the names of Anderson et al., which application is incorporated herein by reference, and in U.S. Pat. No. 5,518,801 issued May 21, 1996 to Chappell et al, which patent is incorporated herein by reference.

The first regions 2061 can extend in a first direction which is inclined at an angle B (FIG. 11) with respect to the longitudinal centerline 21. The angle B can be between about 30 degrees and about 60 degrees. The first regions 2062 can extend in a second direction which is inclined at an angle A with respect to the longitudinal centerline 21. The angle A can be between about 30 and about 60 degrees. In the embodiment shown in FIG. 11, the angles A and B can both be about 45 degrees. The angle C between the first and second directions is preferably between about 45 degrees to about 135 degrees.

In the embodiment shown in FIG. 11, the first and second directions are substantially perpendicular to one another. The intersection of the first regions 2061 with the first regions 2062 forms a boundary, indicated by phantom line 2063 in FIG. 12, which completely surrounds the second regions 2066.

For simplicity, the strainable network is shown on only a portion of the bib 20 above the pocket opening 110. It will be understood that the strainable network can cover some or all of the body panel 70 extending above the pocket opening 110. For instance, the strainable network can extend over a portion of all of the shoulder extensions 24, 26, or alternatively can be omitted from the shoulder extensions 24, 26. Alternatively, the strainable network can cover some or all of the pocket panel 105 and the apron panel 150.

The strainable network shown in FIGS. 11 and 12 is viewed from the body facing surface 82 of the bib 20. Referring to FIG. 12, the second regions 2066 include a plurality of raised, rib-like elements 2074. The rib like elements 2074 extend outward from surrounding portions of the strainable network (toward the viewer in FIG. 12) to form ridges in the body facing surface 82. Valleys corresponding to the ridges form depressions in the surface 42.

As shown in FIG. 12, the strainable network has an axis L and a mutually perpendicular axis T. The axis L of the strainable network is substantially parallel to the longitudinal centerline 21 of the bib in FIG. 11.

The width 2068 of the first regions 2060 can be from about 0.01 inch to about 0.5 inch. In one embodiment, the width 2068 is about 0.030 inch.

The second regions 2066 have a first axis 2070 and a second axis 2071. The first axis 2070 is substantially parallel to the axis T, and the second axis is substantially parallel to the axis L. The rib like elements 2074 may be embossed, debossed, or a combination thereof. The rib-like elements have a first or major axis 2076 and a second or minor axis 2077. In FIG. 11, the major axis 2076 of the rib like elements 2074 is substantially perpendicular to the the longitudinal centerline 21 of the bib 20.

When the strainable network of the type shown in FIG. 12 is subjected to an applied elongation (indicated by arrows 2080 in FIG. 12) along an axis, the first regions 2061 and 2062 provide most of the initial resistive force as a result of molecular level deformation, while the second regions 2066 are experiencing geometric deformation. In addition, the shape of the second regions 2066 changes as a result of the movement of the reticulated structure formed by the intersecting first regions 2061 and 2062. Accordingly, as the strainable network is subjected to the elongation, the first regions 2061 and 2062 experience geometric deformation, thereby changing the shape of the second regions. The second regions 2066 are extended or lengthened in a direction parallel to the direction of the applied elongation, and are foreshortened in a direction perpendicular to the direction of the applied elongation. This characteristic of the strainable network shown in FIG. 12 is described in above referenced U.S. patent application Ser. No. 08/656,129, entitled "Web Materials Exhibiting Elastic-Like Behavior and Soft Cloth-Like Texture" filed May 31, 1996.

Without being limited by theory, it is believed that the strainable network shown in FIGS. 11 and 12 provides elastic like behavior parallel to the bib axis 21, while providing bending flexibility about both lateral and longitudinal axes. The elastic like behavior parallel to the bib axis 21 allows young wearers to tug on the bib without tearing the shoulder extensions 24, 26, especially if the strainable network extends at least partially into the shoulder extensions 24, 26. Additionally, the strainable network shown in FIGS. 11 and 12 is believed to provide the advantage that when the bib is elongated in a direction parallel to the axis 21, the sides 32, 34 of the bib tend to curl outward, away from the wearer thereby helping to direct materials spilled or dripped on the surface 42 into the pocket 100.

Figure 13:
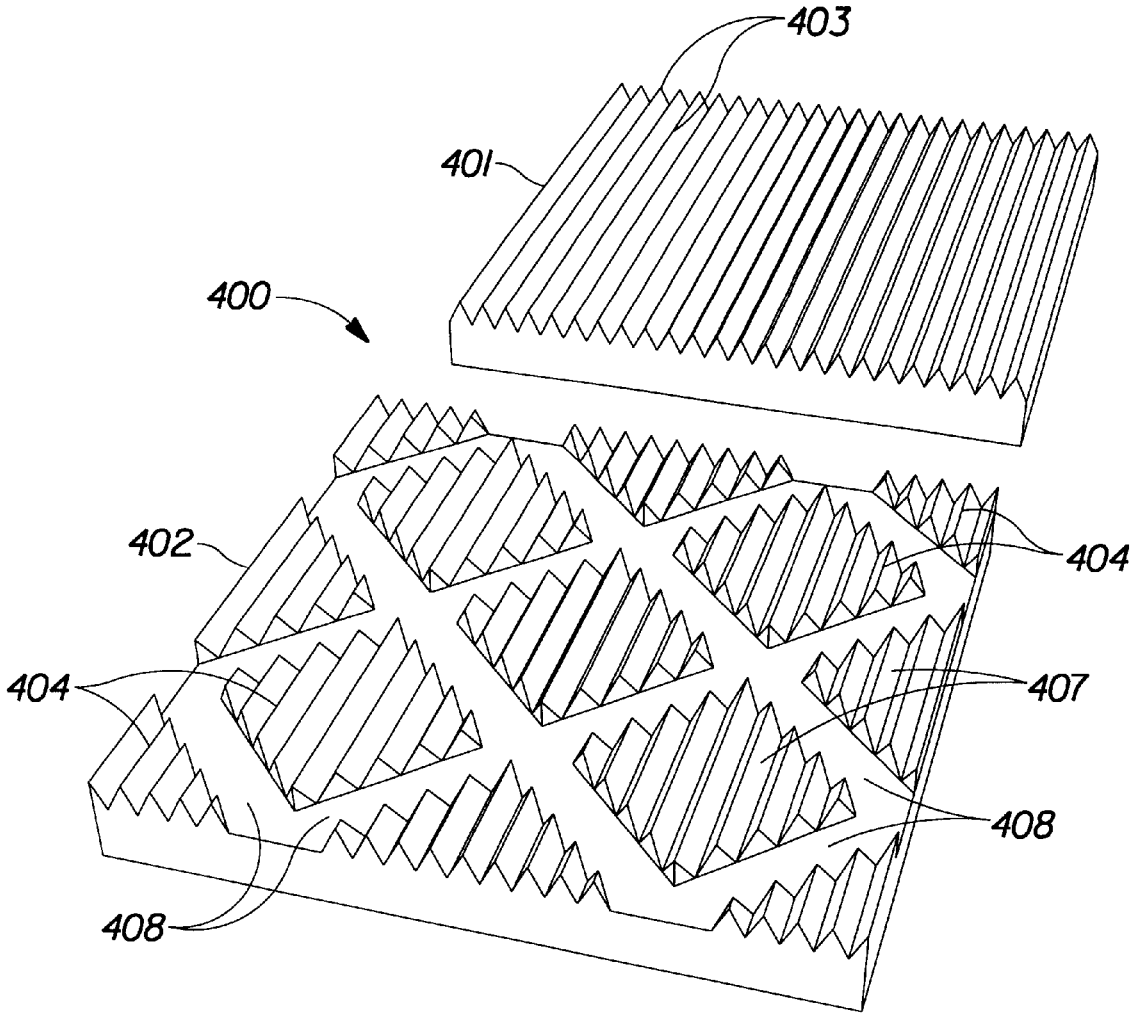
FIG. 13 is a schematic perspective illustration of a toothed apparatus used to form the strainable network shown in FIG. 11.
Figure 14:
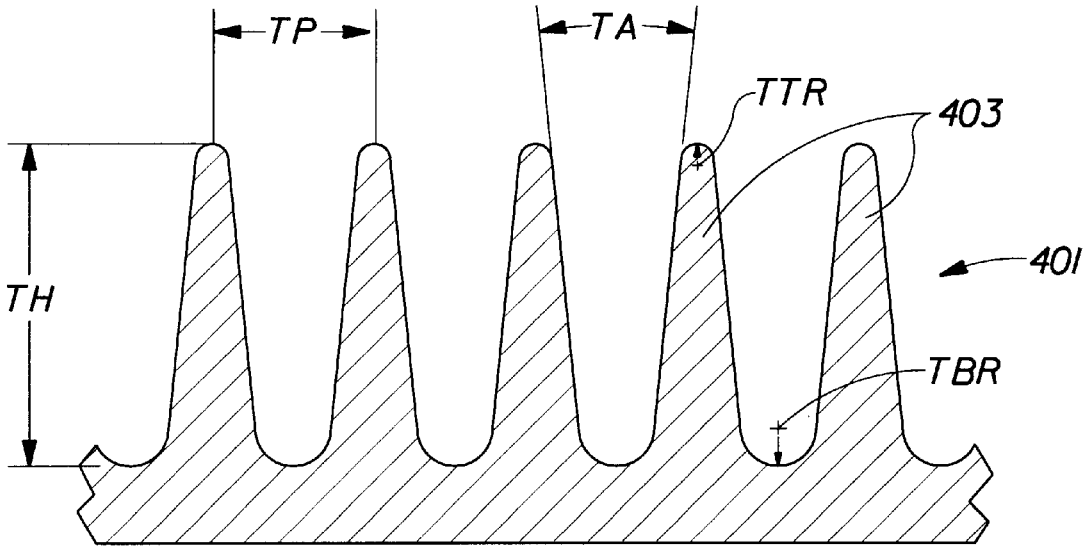
FIG. 14 is a cross-sectional illustration of a portion of the apparatus of FIG. 13.
Figure 15:
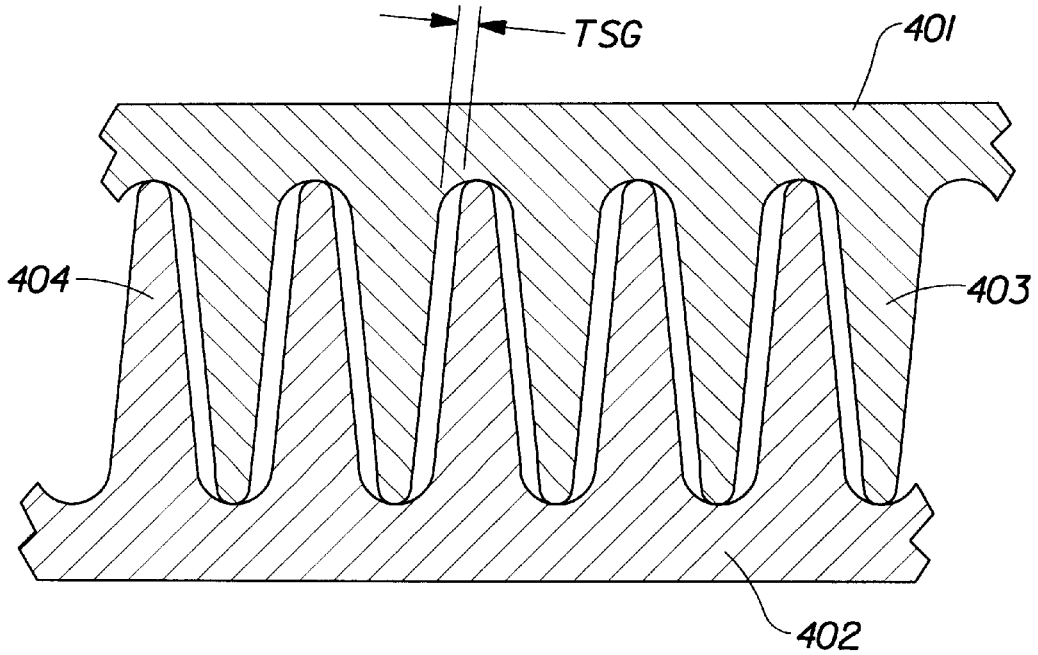
FIG. 15 is a cross-sectional illustration of the apparatus of FIG. 13 showing engagement of the teeth used to form the strainable network.

FIG. 13 shows a toothed apparatus 400 which can be used to form the strainable network shown in FIG. 12. FIG. 14 is a cross-sectional illustration of a portion of the apparatus of FIG. 13. FIG. 15 is a cross-sectional illustration of the apparatus of FIG. 13 showing engagment of the teeth used to form the strainable network.

Referring to FIG. 13, the apparatus 400 includes intermeshing plates 401 and 402. Plates 401 and 402 include a plurality of intermeshing teeth 403, 404, respectively. The strainable network is formed by placing the bib laminate between the plates 401 and 402, and bringing the plates 401, 402 together under loading to form the strainable network. Preferably, the paper topsheet 40 is positioned against the plate 402 and the backsheet 80 is positioned against the plate 401.

Plate 402 includes toothed regions 407 and grooved region 408. Within the toothed regions 407 there are a plurality of teeth 404. Plate 401 includes teeth 403 which mesh with teeth 404 of plate 402. When a substrate, such as a laminate of topsheet 40 and backsheet 80, is formed between plates 401, 402, the portions of the substrate which are positioned between grooved regions 408 of plate 402 and teeth 403 on plate 401 remain undeformed. These regions correspond to the first regions 2060. The portions of the substrate positioned between toothed regions 407 of plate 402 and teeth 403 of plate 401 are formed creating rib-like elements 2074 in the second regions 2066.

The plate 401 is shown in cross-section in FIG. 14. The teeth 401 (and the teeth 404 on plate 402) can have the following characteristics to form a strainable network in the laminate comprising the paper topsheet 40 and the plastic film backsheet 80: The tooth height TH can be about 0.0800 inch, the tooth pitch TP can be about 0.0400 inch, the tooth angle TA can be about 11.31 degrees, the tooth tip radius TTR can be about 0.0040 inch, and the tooth base radius TBR can be about 0.0093 inch.

FIG. 15 shows intermeshing of the plates 401 and 402 without a substrate positioned between the plates. The plates 401 and 402 can intermesh to have a tooth side gap TSG of about 0.0048 inch, as shown in FIG. 15.

For example, a strainable network of the type shown in FIG. 11 can be imparted to the laminate of the paper topsheet 40 and plastic film backsheet 80 using the following procedure. The laminate comprises a two ply BOUNTY brand paper towel manufactured by The Procter and Gamble Co. joined to a polyethylene film having a thickness of about 0.002 inch. The total thickness of the laminate of the topsheet 40 and backsheet 80 is about 0.020 inch prior to pressing. The laminate is placed between the plates 401 and 402. The laminate is pressed between the plates with a compressive loading to compress the assembly of the plates 401,402 and the laminate about 0.040 inch. The compressive loading is then released, and the laminate having the formed strainable network is removed from between the plates 401, 402. The resulting laminate having the strainable network has a thickness of about 0.050 inch.

Figure 16:
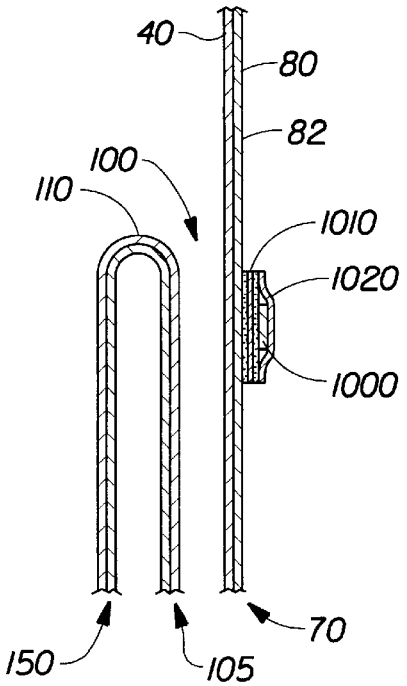
FIG. 16 is a partial cross-sectional view taken along line 12—12 in FIG. 11 and showing an elastic element joined to a backsheet portion of the bib.
Figure 17:
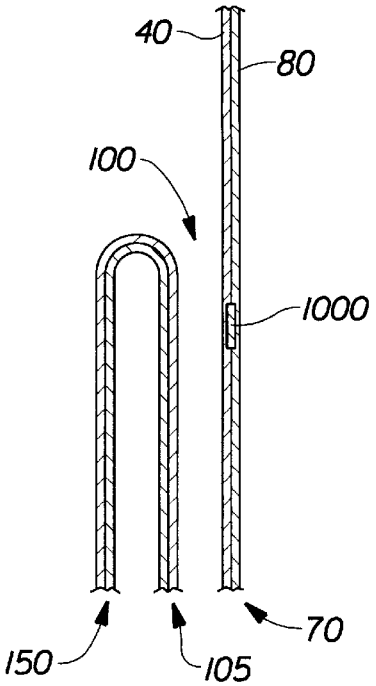
FIG. 17 is a partial cross-sectional view of the type shown in FIG. 16 showing an elastic element disposed between the topsheet and the backsheet.
Figure 18:
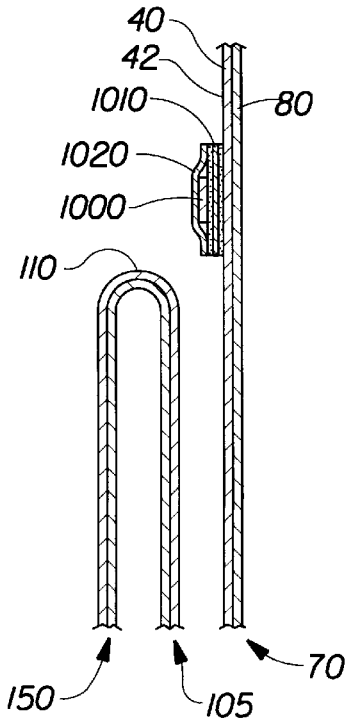
FIG. 18 is a partial cross-sectional view of the type shown in FIG. 16 showing an elastic element joined to the topsheet.

FIGS. 16, 17, and 18 illustrate different placements of the elastic member 1000 on the bib 20. In FIG. 16, the elastic member 1000 is joined to the surface 82 of the backsheet 80 with a strip of double sided tape 1010. A strip of nonwoven material 1020 covers the elastic member 1000 and the portions of the double sided tape extending from the elastic member 1000.

In FIG. 17, the elastic member 1000 is disposed intermediate the topsheet 40 and the backsheet 80. The elastic member 1000 can be joined to one or both of the topsheet and the backsheet with any suitable adhesive. A suitable adhesive for joining the topsheet 40 and the backsheet 80 is a hot melt adhesive such as a hot melt pressure sensitive adhesive. Suitable adhesives include adhesives designated HL-1258 and HL 1262 manufactured by H. B. Fuller Co. of St. Paul, Minn. Other suitable adhesives include Findley Adhesives H2031 and H2120 available from Findley Adhesives of Elmgrove, Wis.

In FIG. 18, the elastic member 1000 is joined to the surface 42 of the topsheet 40 with a strip of double sided tape 1010. In FIG. 18, the elastic member 1000 is positioned adjacent to the pocket 100, and is located just above the pocket open edge 110 along the longitudinal centerline 21. The elastic member 1000 provides lateral foreshortening of a portion of the body panel 70 positioned longitudinally above the pocket space, and promotes folding of the body panel along the crease 570.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of the invention.

What is claimed:

1. A disposable bib having a longitudinal centerline, the bib comprising:

a body panel;

a pocket panel disposed adjacent the body panel for providing a pocket space intermediate the body panel and the pocket panel, the pocket panel comprising a pocket open edge; and an elastic member attached to one of the body panel or the pocket panel;

wherein at least one of the pocket panel and the body panel comprises a predetermined hinge line; and wherein at least a portion of the bib is foreshortened by the elastic member to provide deformation of the bib at the predetermined hinge line and opening of the pocket space.

2. The bib of claim 1 wherein at least a portion of the pocket panel is foreshortened.

3. The bib of claim 1 wherein at least a portion of the body panel is foreshortened.

4. The bib of claim 1 wherein at least a portion of the bib associated with the pocket open edge is foreshortened.

5. The bib of claim 4 wherein a portion of the body panel associated with the pocket open edge is foreshortened.

6. The bib of claim 1 wherein a portion of the body panel spaced longitudinally from the pocket space is foreshortened.

7. The bib of claim 1 wherein a portion of one of the pocket panel and the body panel is foreshortened, and wherein the predetermined hinge line is disposed on the other of the pocket panel and the body panel.

8. The bib of claim 1 wherein at least a portion of at least one of the pocket panel and the body panel is foreshortened, and wherein the predetermined hinge line is disposed on a panel, a portion of which is foreshortened.

9. The bib of claim 1 wherein at least a portion of the body panel is foreshortened, and wherein the predetermined hinge line is disposed on the body panel.

10. The bib of claim 9 wherein the predetermined hinge line comprises a longitudinally extending crease.

11. The bib of claim 10 wherein the predetermined hinge line comprises a longitudinally extending crease which is substantially parallel to the longitudinal centerline of the bib.

12. The bib of claim 11 wherein the longitudinally extending crease is substantially aligned with the longitudinal centerline of the bib.

13. The bib of claim 1 wherein the bib is foreshortened in a direction inclined with respect to the predetermined hinge line.

14. The bib of claim 13 wherein the bib is foreshortened in generally lateral direction and wherein the predetermined hinge line is substantially parallel to the longitudinal centerline of the bib.

15. The bib of claim 14 wherein the predetermined hinge line is substantially aligned with the longitudinal centerline of the bib.

16. A disposable bib having a longitudinal centerline, the bib comprising;

a body panel having side edges; and a pocket panel disposed adjacent the body panel for providing a pocket space intermediate the body panel and the pocket panel, the pocket panel comprising a pocket open edge, side edges, and a bottom edge;

wherein at least one of the pocket panel and the body panel comprises a longitudinally extending predetermined hinge line spaced from the side edges of the panel; and a pocket opening mechanism comprising an elastic member for providing deformation of the bib at the predetermined hinge line and opening of the pocket space.

17. The disposable bib of claim 16 wherein the elastic member provides foreshortening of a portion of the bib in a direction inclined with respect to the predetermined hinge line.

18. The disposable bib of claim 17 wherein the elastic member provides lateral foreshortening of a portion of the bib, and wherein the predetermined hinge line is substantially parallel to the longitudinal centerline of the bib.

19. The disposable bib of claim 18 wherein the predetermined hinge line is substantially aligned with the longitudinal centerline of the bib.

* * * * *